US006973964B2

(12) United States Patent
Hul-Chun

(10) Patent No.: US 6,973,964 B2
(45) Date of Patent: Dec. 13, 2005

(54) END SURFACE STRUCTURE OF HEAT PIPE FOR CONTACT WITH A HEAT SOURCE

(76) Inventor: Hsu Hul-Chun, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/811,889

(22) Filed: Mar. 30, 2004

(65) Prior Publication Data

US 2005/0224216 A1 Oct. 13, 2005

(51) Int. Cl.[7] ..... F28D 15/00

(52) U.S. Cl. ..... 165/104.26; 165/104.33; 361/700; 361/697; 174/15.2

(58) Field of Search ..... 165/104.26, 104.33, 165/104.21, 104.19, 185; 361/700; 257/714–716; 174/15.2

(56) References Cited

U.S. PATENT DOCUMENTS 2,883,591 A * 4/1959 Camp ..... 257/715
2,958,021 A * 10/1960 Cornelison et al. ..... 257/715
5,412,535 A * 5/1995 Chao et al. ..... 361/700
5,582,242 A * 12/1996 Hamburgen et al. ... 165/104.21
5,632,158 A * 5/1997 Tajima ..... 62/259.2
6,793,009 B1 * 9/2004 Sarraf ..... 165/104.33
6,827,133 B1 * 12/2004 Luo ..... 165/104.21
2003/0066628 A1 * 4/2003 Mochizuki et al. .... 165/104.26

* cited by examiner

*Primary Examiner*—Terrell McKinnon

(57) ABSTRACT

An end surface structure of a heat pipe having a large gauge used to be contacted with a heat source for dissipation is provided. The heat pipe includes a pipe member, a lid, a base and a wick structure. The hollow tubular pipe member has two opposing open ends. The lid is closely covered on one open end. The base provides an interlocking member including a flange fitly embracing the pipe member to receive the other open end of the pipe member thereinside. The wick structure is attached on an inner wall of the pipe member and an inside surface of the base. Moreover, the thickness of the flange is not larger than the thickness of pipe member at the open end received in the interlocking member. When the base is fitted with the pipe member at the open end, a welding process is performed to permanently connect them together. In the welding process, the flange of the interlocking member is enforced to be liquefied first and is liquefied more than the pipe member at the open end. As such, it can ensure that the pipe member is prevented from being damaged during the welding process.

7 Claims, 5 Drawing Sheets

END SURFACE STRUCTURE OF HEAT PIPE FOR CONTACT WITH A HEAT SOURCE

BACKGROUND OF THE INVENTION

The present invention relates in general to an end surface structure of a heat pipe, and more particularly, to an end surface structure of a heat pipe having a large gauge, which is used to be contacted with a heat source for dissipation.

Having the characteristics of high thermal conductivity, fast thermal conduction, light weight, non-movable components and simple structure, the heat pipes are able to deliver large amount of heat without consuming electricity, and are therefore commonly used in the market.

FIG. 1 illustrates a heat pipe 1*a* having one end capably to be contacted with a heat source for dissipation. The heat pipe 1*a* includes a lid 12*a*, and a pipe member 10*a* with a close end and an open end. A wick structure 11*a* is attached to the inner wall of the pipe member 10*a* and the working fluid will be filled in the pipe member 10*a* thereafter. The wick structure 11*a* provides capillary force to transport the working fluid filled in the pipe member 1*a*. The lid 12*a* is provided to cover on the open end of the pipe member 1*a*. The lid 12*a* has a filling tube 120*a* for the working fluid to be filled into the pipe member 1*a* thereby. Moreover, after some further process such as vacuuming, the pipe member 10*a* is sealed with a sealing structure 121*a* on the filling tube 120*a* by the application of tin or soldering.

The above heat pipe 1*a* has a large gauge and provides a flat surface 100*a* to be contacted with the heat source. Therefore, in application, the heat pipe 1*a* can stand on the heat source.

However, normally this kind of heat pipe 1*a* is fabricated by forging process. Therefore, the fabrication is more difficult with higher cost and is impossible for mass production. Furthermore, the heat pipe 1*a* with longer pipe member 10*a* may not be fabricated by forging. Such that, the large gauge heat pipe is still highly demanded in market.

Therefore, there exist inconvenience and drawbacks for practically application of the above-mentioned heat pipe. There is thus a substantial need to provide an improved end surface structure of heat pipe that resolves the above drawbacks and can be used more conveniently and practically.

SUMMARY OF THE INVENTION

The present invention provides an end surface structure of a heat pipe that can be easily fabricated and suitable for mass production.

The end surface structure provided by the present invention includes a pipe member, a lid and a base. The pipe member is a hollow tube with a wick structure attached to an inner wall thereof. The pipe member includes two opposing open ends. The lid is closely covered on one open end. The base provides an interlocking member including a flange fitly embracing the pipe member to receive the other open end of the pipe member thereinside. Moreover, the thickness of the flange is not larger than the thickness of pipe member at the open end received in the interlocking member. When the base is fitted with the pipe member at the open end, a welding process is performed to permanently connect them together. In the welding process, the flange of the interlocking member is enforced to be liquefied first and is liquefied more than the pipe member at the open end. As such, it can ensure that the pipe member is prevented from being damaged during the welding process, and an effective production can be obtained.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF ACCOMPANIED DRAWINGS

The above objects and advantages of the present invention will be become more apparent by describing in detail exemplary embodiments thereof with reference to the attached drawings in which.

DETAILED DESCRIPTION OF EMBODIMENT

Figure 1:
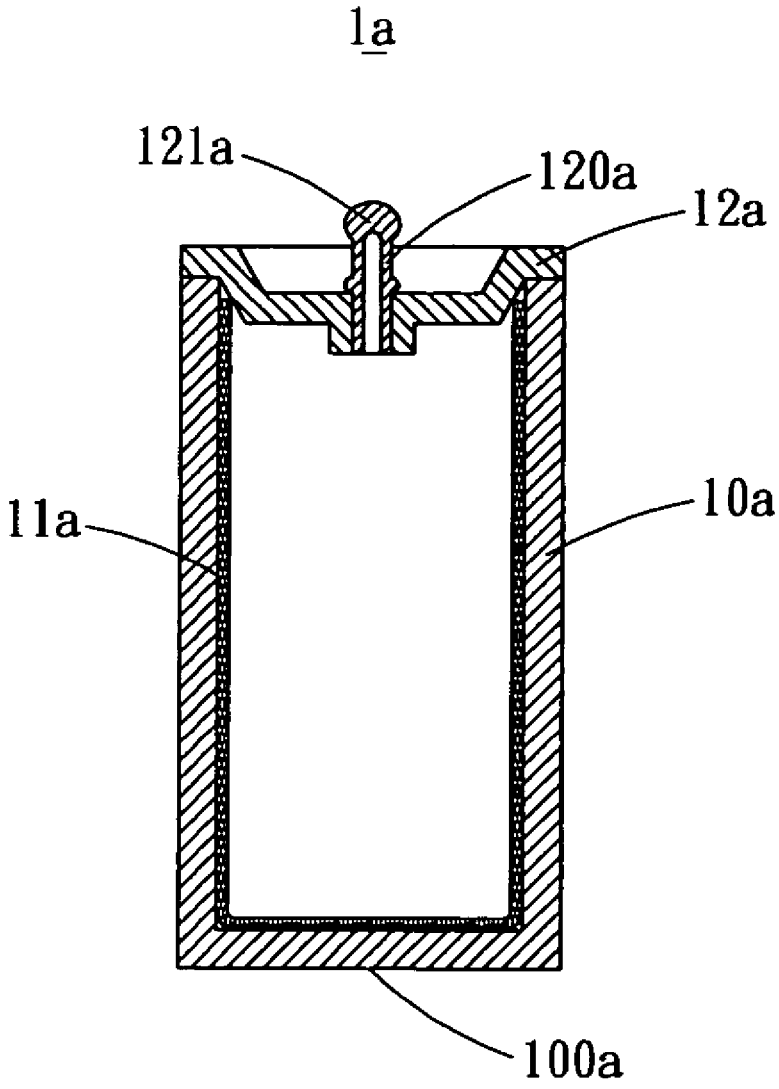
FIG. 1 PRIOR ART
FIG. 1 illustrates a cross sectional view of a conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Figure 2:
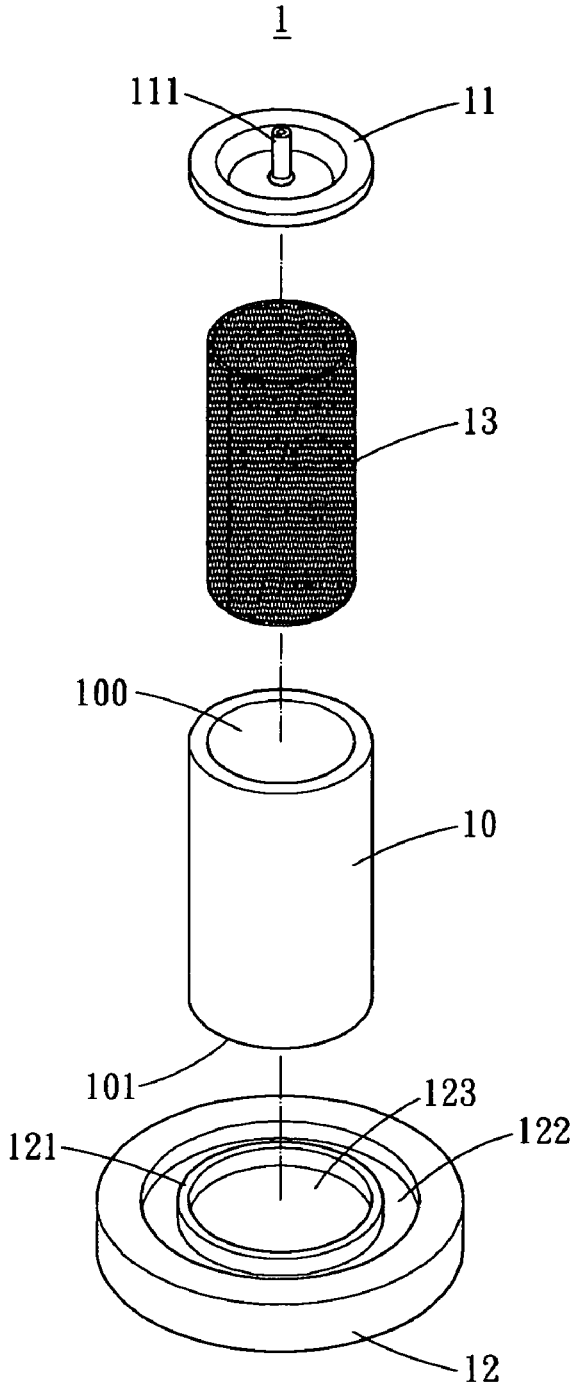
FIG. 2 shows an exploded view of a heat pipe provided by the present invention.
Figure 3:
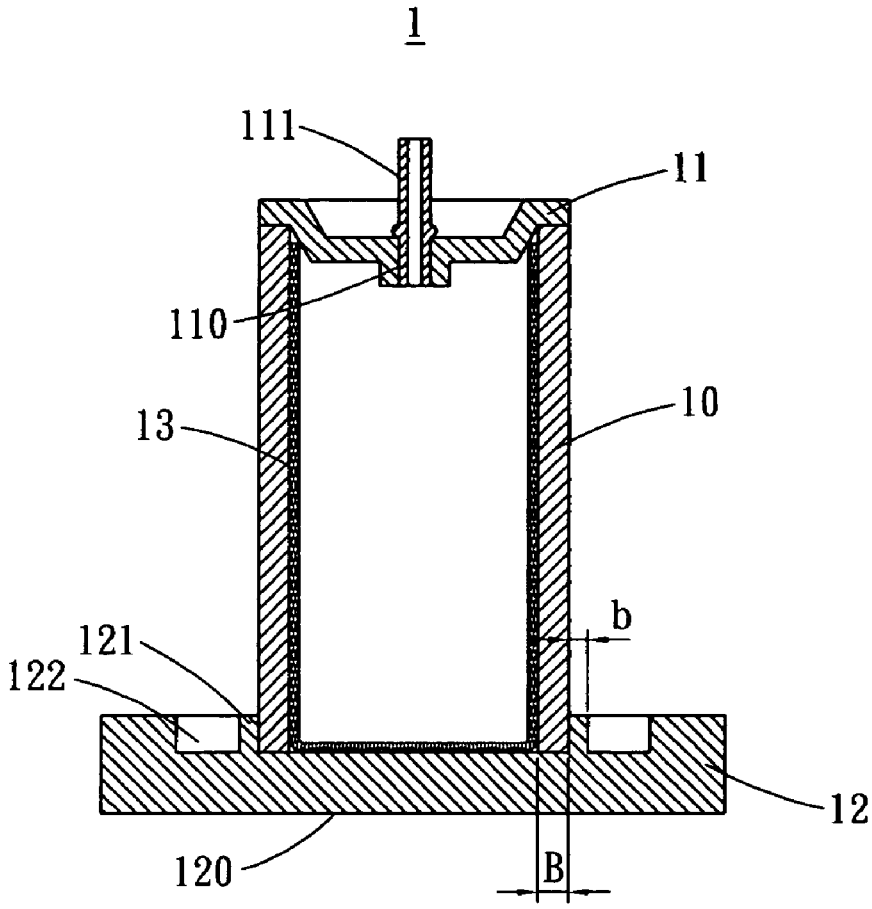
FIG. 3 is a cross sectional view of the assembled heat pipe.

As shown in FIGS. 2 and 3, the exploded view and cross sectional view of a heat pipe provided by the present invention are illustrated. As shown, the heat pipe 1 includes a pipe member 10, a lid 11 and a base 12.

Figure 4:
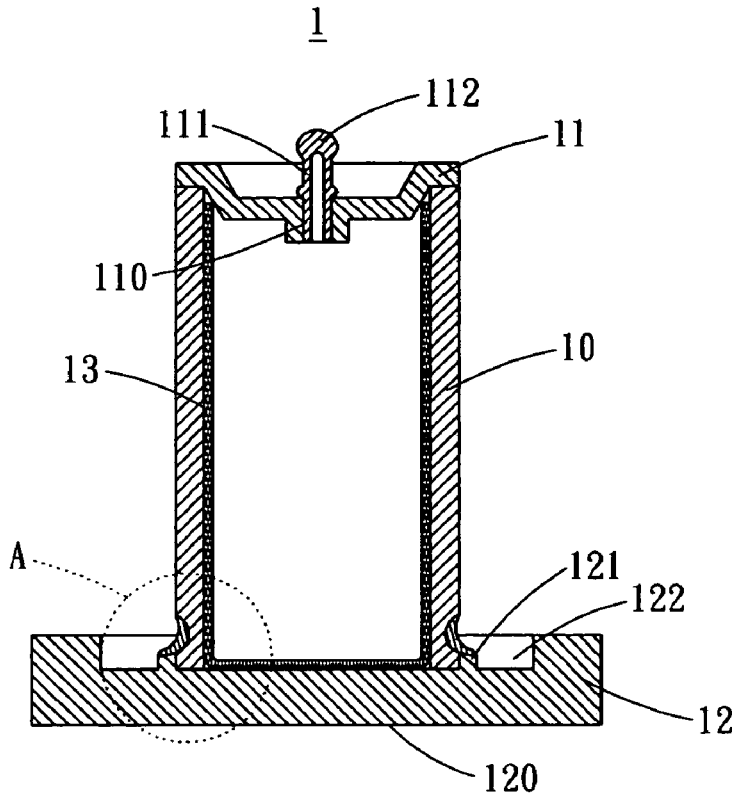
FIG. 4 is a cross sectional view of the heat pipe after a welding process.

The pipe member 10 is preferably a cylindrical hollow tube with two open ends 100 and 101. A wick structure 13 is attached to an inner wall of the pipe member 10. The lid 11 includes a thin plate fabricated by press, for example, and is applied to seal the pipe member 10 at one open end 100 by closely covering thereon. The other open end 101 is then sealed by the base 12, and the wick structure 13 is further extended to attach on the inside surface (opposite to the outside surface 120) of the base 12. In addition, the lid 11 has a through hole 110 for a filling tube 111 being mounted therein, such that the working fluid can be filled inside the pipe member 10 thereby. After some further process such as vacuuming, the heat pipe 1 is sealed with a sealing structure 112 (as shown in FIG. 4) on the filling tube 113 by the application of tin or soldering. Furthermore, the base 12 provides the outside surface 120 which is a flat surface for contact with a heat source. Therefore, the heat pipe 1 with an end surface to be contacted with the heat source for dissipation is obtained.

In the present invention, the pipe member 10 is permanently connected with the base 12 by a welding process after interlocking them together. The base 12 includes an interlocking member 121 for receiving the open end 101 of the pipe member 10. The interlocking member 121 includes a flange to embrace the received open end 101 of the pipe member 10, which is made by forming a circular recess 123 adjacently inside the flange and an annular slot 122 adjacently outside the flange. As the shape and the size of the flange of the interlocking member 121 is fitted to the exterior surface of the open end 101, the pipe member 10 is embedded in the circular recess 123 under an engagement with the interlocking member 121. Therefore, the interlocking member 121 positions the base 12 along the axial and radial direction of the pipe member 10. Moreover, the thickness b of the flange of the interlocking member 121 is not larger than the thickness B of the wall (side surface) of the pipe member 10 at the open end 101.

Figure 5:
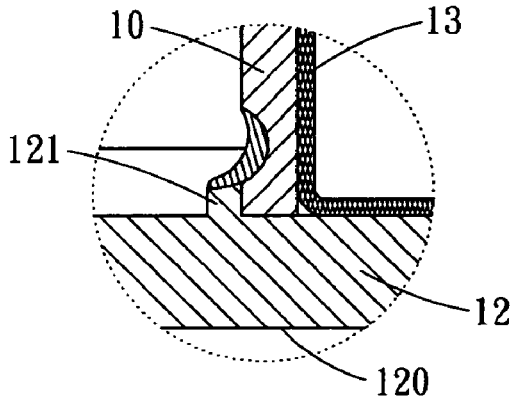
FIG. 5 shows a local enlarged view of the portion A as shown in FIG. 4.

As shown in FIGS. 4 and 5, while the base 12 is interlocked with the pipe member 10 at the open end 101, a welding process is applied. As the thickness b of the flange of the interlocking member 121 is not larger than the thickness B of the wall of the pipe member 10 at the open end 101, the flange of the interlocking member 121 is enforced to be liquefied first, and is liquefied more than the wall of the pipe member 10 at the open end 101. As such, it can ensure that the wall of the pipe member 10 at the open end 101 will not be damage due to the fusion in the welding process. The interlocking 121 does not only provide axial and radial positioning of the base 12 to the pipe member 10, but the flange of the interlocking member 121 also serve as fusion region between the pipe member 10 and the base 12 to obtain a good welding effect. Thereby, the heat pipe 1 can be fabricated by mass production with enhanced yield rate.

Figure 6:
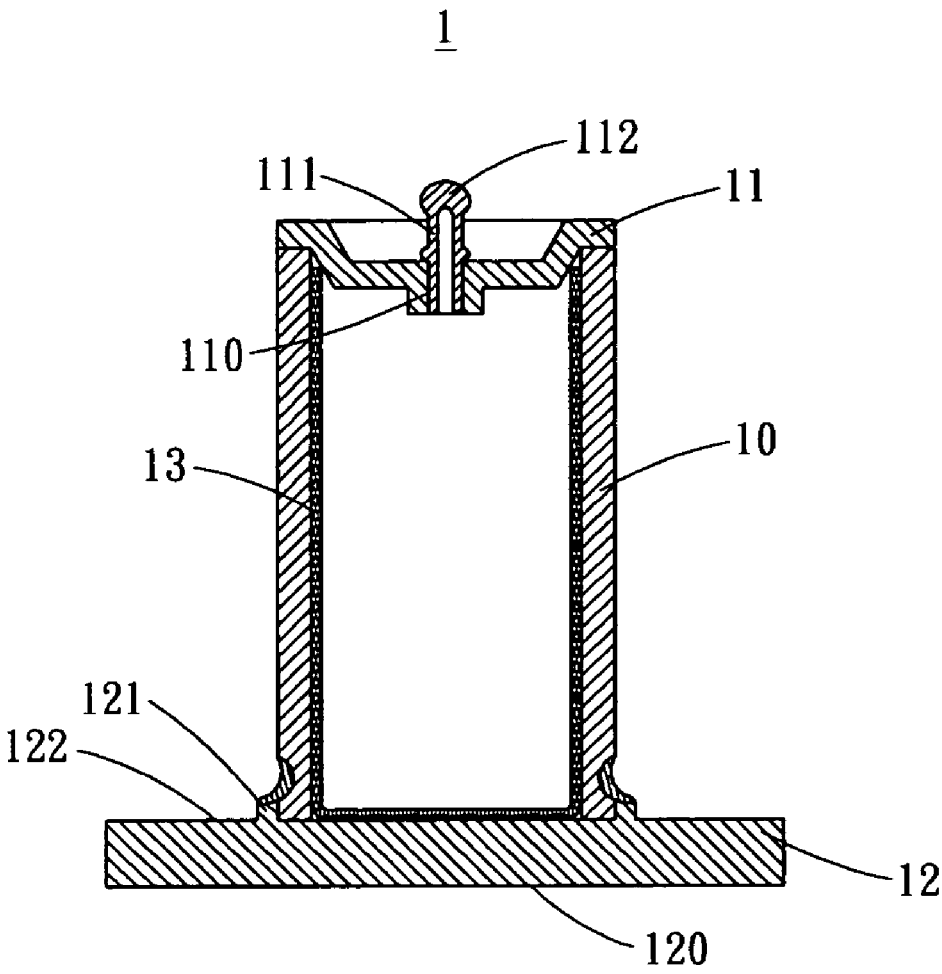
FIG. 6 shows a cross sectional view of a heat pipe according to another preferred embodiment.

Finally, as shown in FIG. 6, it illustrates another preferred embodiment of the present invention. In this preferred embodiment, the annular slot 122 is extended outwardly to the whole base 12 to obtain a more uniform structure of the base 12. As such, the residual stress and heat deformation after the welding process is reduced. Therefore, the structure of heat pipe 1 can be enhanced.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A heat pipe, comprising:

a pipe member having two opposing open ends;

a lid closely covered on one open end;

a base having an interlocking member with a flange fitly embracing the pipe member to receive the other open end of the pipe member therein, wherein a thickness of the flange is not larger than a thickness of pipe member at the open end received in the interlocking member; and a wick structure attached on an inner wall of the pipe member and an inside surface of the base.

2. The heat pipe as claimed in claim 1, wherein the pipe member is a cylindrical pipe.

3. The heat pipe as claimed in claim 1, wherein the lid includes a filling tube mounted thereon for working fluid to be filled in the pipe member.

4. The heat pipe as claimed in claim 3, wherein the pipe member is sealed with a sealing structure on the filling tube.

5. The heat pipe as claimed in claim 1, wherein the base includes a flat surface opposite to the inside surface for contact with a heat source.

6. The heat pipe as claimed in claim 1, wherein the interlocking member is made by forming a circular recess adjacently inside the flange and an annular slot adjacently outside the flange.

7. The heat pipe as claimed in claim 6, wherein the annular slot is extended outwardly to the whole base.

* * * * *